US009227314B2

(12) United States Patent
Crorey

(10) Patent No.: US 9,227,314 B2
(45) Date of Patent: Jan. 5, 2016

(54) DEVICE AND KIT FOR MAKING IMAGES FOR JEWELRY AND ACCESSORIES

(71) Applicant: David J. Crorey, Clinton Township, MI (US)

(72) Inventor: David J. Crorey, Clinton Township, MI (US)

( * ) Notice: Subject to any disclaimer, the term of this patent is extended or adjusted under 35 U.S.C. 154(b) by 301 days.

(21) Appl. No.: 13/681,767

(22) Filed: Nov. 20, 2012

(65) Prior Publication Data

US 2013/0291388 A1 Nov. 7, 2013

Related U.S. Application Data

(63) Continuation-in-part of application No. 29/420,231, filed on May 7, 2012, now Pat. No. Des. 685,823.

(51) Int. Cl.
*B26D 5/08* (2006.01)
*B25F 1/00* (2006.01)
*A44C 27/00* (2006.01)

(52) U.S. Cl.
CPC .. *B25F 1/00* (2013.01); *A44C 27/00* (2013.01)

(58) Field of Classification Search
CPC ..... A44C 27/00; B25F 1/00
USPC ..... 83/582, 633, 686, 549, 687, 690, 691, 83/167, 864
See application file for complete search history.

(56) References Cited

U.S. PATENT DOCUMENTS 46,066 A * 1/1865 Bergner ..... 83/466.1
562,981 A 6/1896 Sprinkle
685,212 A 10/1901 Knowlton
2,482,218 A 9/1949 Segal
2,534,094 A 12/1950 Yerkes
4,438,579 A 3/1984 Engel
4,688,457 A 8/1987 Neilsen et al.
4,898,055 A 2/1990 Neilsen
5,031,495 A 7/1991 Kogane et al.
5,525,187 A 6/1996 Pascal et al.
5,647,278 A * 7/1997 Wu ..... 101/368
5,725,469 A 3/1998 Rehkemper et al.
5,829,334 A 11/1998 Evans et al.
6,000,139 A * 12/1999 Chan ..... 30/358
6,076,447 A * 6/2000 Damask ..... 83/618
6,209,434 B1 4/2001 Kim et al.
6,349,453 B1 2/2002 Nicoletti et al.
6,428,248 B1 * 8/2002 Lee ..... 407/117
6,513,413 B2 * 2/2003 Lee ..... 83/633
6,629,434 B2 10/2003 Chia et al.
6,715,911 B2 4/2004 Villarreal et al.
6,739,244 B1 * 5/2004 Carbaugh ..... 101/3.1
6,742,431 B1 * 6/2004 Oh ..... 83/687
6,752,058 B2 * 6/2004 Oh ..... 83/620
6,840,145 B1 * 1/2005 Lee ..... 83/167

(Continued)

*Primary Examiner* — Omar Flores Sanchez
(74) *Attorney, Agent, or Firm* — Young Basile

(57) ABSTRACT

Disclosed herein are embodiments of apparatuses and kits for making craft image tiles to customize jewelry or other accessories. One embodiment of an apparatus for making craft image tiles comprises a base having a top surface and a bottom surface opposite the top surface with a cavity there between; a cutting mechanism movably positioned within the cavity and comprising a cutting blade configured to cut through a sheet of images; and a handle extending from the cutting mechanism and accessible outside of the base, configured to move the cutting blade along an axis substantially perpendicular to the top surface of the base in response to a mechanical input at a handle input end. The top surface includes an aperture defined therein, and the aperture is sized to receive the cutting blade.

19 Claims, 7 Drawing Sheets

(56) References Cited

U.S. PATENT DOCUMENTS

| | | | | |
|---|---|---|---|---|
| 6,938,542 | B1 * | 9/2005 | Ho et al. | 101/31.1 |
| 7,028,507 | B2 * | 4/2006 | Rapport | 63/3 |
| 7,040,778 | B2 | 5/2006 | Villarreal et al. | |
| 7,111,447 | B2 | 9/2006 | Rosenwasser | |
| 7,322,213 | B2 | 1/2008 | Tamir et al. | |
| 7,414,221 | B2 | 8/2008 | Pratt, Sr. et al. | |
| D628,648 | S * | 12/2010 | Chan | D19/72 |
| 7,854,818 | B2 | 12/2010 | Plummer | |
| 7,980,164 | B2 * | 7/2011 | Wang | 83/549 |
| 7,992,475 | B2 * | 8/2011 | Buettner | 83/25 |
| 8,549,972 | B2 * | 10/2013 | Exley | 83/633 |
| 8,651,004 | B2 * | 2/2014 | Liu et al. | 83/684 |
| 8,763,503 | B1 * | 7/2014 | Hunter | 83/167 |
| 2002/0139231 | A1 * | 10/2002 | Lee | 83/549 |
| 2003/0142511 | A1 | 7/2003 | Villarreal et al. | |
| 2004/0129124 | A1 * | 7/2004 | Chan | 83/588 |
| 2006/0248764 | A1 | 11/2006 | Spiegelberg | |
| 2007/0283601 | A1 | 12/2007 | Peterson | |
| 2008/0016914 | A1 | 1/2008 | Golan | |
| 2011/0048072 | A1 | 3/2011 | Mullen et al. | |
| 2011/0120188 | A1 | 5/2011 | Kaupp | |

* cited by examiner

DEVICE AND KIT FOR MAKING IMAGES FOR JEWELRY AND ACCESSORIES

CROSS REFERENCE TO RELATED APPLICATION

This application is a continuation-in-part of U.S. Design patent application Ser. No. 29/420,231 filed on May 7, 2012, incorporated herein in its entirety.

FIELD OF THE INVENTION

The present invention relates in general to hand crafted accessories and more particularly to devices to assist in the making of custom jewelry and accessories using images.

BACKGROUND

A popular craft project involves making jewelry and accessories such as bracelets, necklaces, and buttons. Furthermore, it has become desirable and fashionable to customize these same crafts with different symbols, images or photos. A device that makes it easy and safe to cut image tiles for use in jewelry and crafts would allow a person of any skill level to produce craft products with custom designs and images.

BRIEF SUMMARY

Disclosed herein are embodiments of apparatuses for making craft image tiles to customize jewelry or other accessories. One embodiment of an apparatus for making craft image tiles comprises a base having a top surface and a bottom surface opposite the top surface with a cavity there between; a cutting mechanism movably positioned within the cavity and comprising a cutting blade configured to cut through a sheet of images; and a handle extending from the cutting mechanism and accessible outside of the base, configured to move the cutting blade along an axis substantially perpendicular to the top surface of the base in response to a mechanical input at a handle input end. The top surface includes an aperture defined therein, and the aperture is sized to receive the cutting blade.

Also disclosed herein are embodiments of kits for making image tiles for craft and jewelry accessories. One embodiment of a kit for making image jewelry tile bracelets comprises an apparatus for making craft image tiles comprising a base having a top surface and a bottom surface and a cavity there between and a cutting mechanism comprising a cutting blade configured to cut through a sheet of images and a handle, the handle extending from the cutting blade and accessible outside of the base, configured to move the cutting blade along an axis substantially perpendicular to the top surface of the base in response to a mechanical input. The top surface includes an aperture defined therein sized to receive the cutting blade, and the cutting blade is configured to move from a first position within the cavity and a second position extending through the aperture. A plurality of tiles are each configured to retain and display an image.

In yet another embodiment, a kit for making image tiles for jewelry and other accessories comprises a plurality of tiles each configured to retain and display an image, each tile comprising at least one surface for retaining an image and at least one channel extending through the time in a direction parallel to a plane of the at least one surface. Elastic material is sized to be threaded through the at least one channel to threadably connect at least some of the plurality of tiles.

Other embodiments are described in more detail in the detailed description herein.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS

Figure 1:
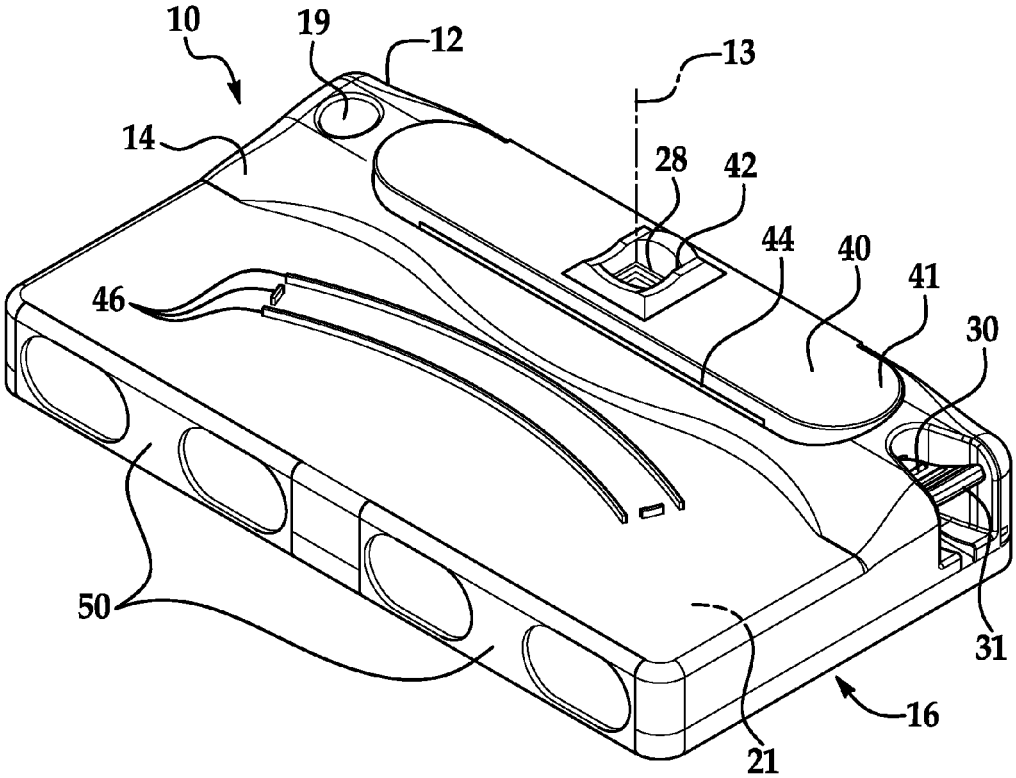
FIG. 1 is a perspective view of an embodiment of an apparatus for making image tiles as disclosed herein.

FIG. 1 is a perspective view of an embodiment of an apparatus 10 for making image tiles for use in jewelry and other accessories. The apparatus 10 comprises a base 12 having a top surface 14 and a bottom surface 16 forming a cavity 21 there between. Apparatus 10 includes a cutting mechanism 20 (shown in FIG. 7) having a cutting blade 22 positioned within a cavity 21 and configured to cut images from a sheet of images for use in jewelry and accessories. The cutting mechanism includes a handle 30 attached to the cutting blade 22. The handle 30 can consist of a cutting connection 33, a base connection 32, and an input end 31. The cutting mechanism 20 is configured to cut a tile material in a particular shape to be used for the craft or jewelry project. Handle 30 is configured to move the cutting blade 22 of the cutting mechanism 20 along an axis 13 substantially perpendicular to the top surface 14 of the base 12 in response to a mechanical input at a handle input end 31. As used herein, "substantially perpendicular to" means the cutting blade can be moved in a direction that is substantially perpendicular to the top surface of the base 12, via a transverse or rotational movement. The top surface 14 has an aperture 28 located proximate to the cutting blade 22, both of which share central axis 13.

Figure 11:
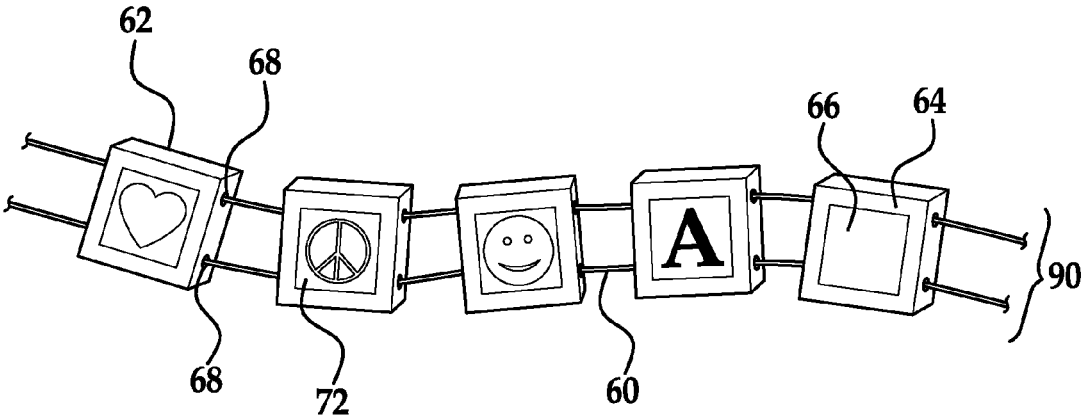
FIG. 11 is a perspective view of a piece of jewelry produced with the apparatus and kits disclosed herein.

FIG. 1 illustrates a rectangular shaped base 12; however, a variety of shapes and designs are contemplated. The base 12 can be constructed of a top piece 15 and a bottom piece 17 as shown in FIG. 11, or can be a one-piece design. Top surface 14 is substantially planar, but can include designs and/or contours in any aesthetically pleasing configuration. As used herein, "substantially planar surface" means having a two-dimensional characteristic. The term does not limit the surface to being smooth, as the surface may be textured if desired or required. FIGS. 1-6 show different views of one embodiment of base 12.

Figure 7:
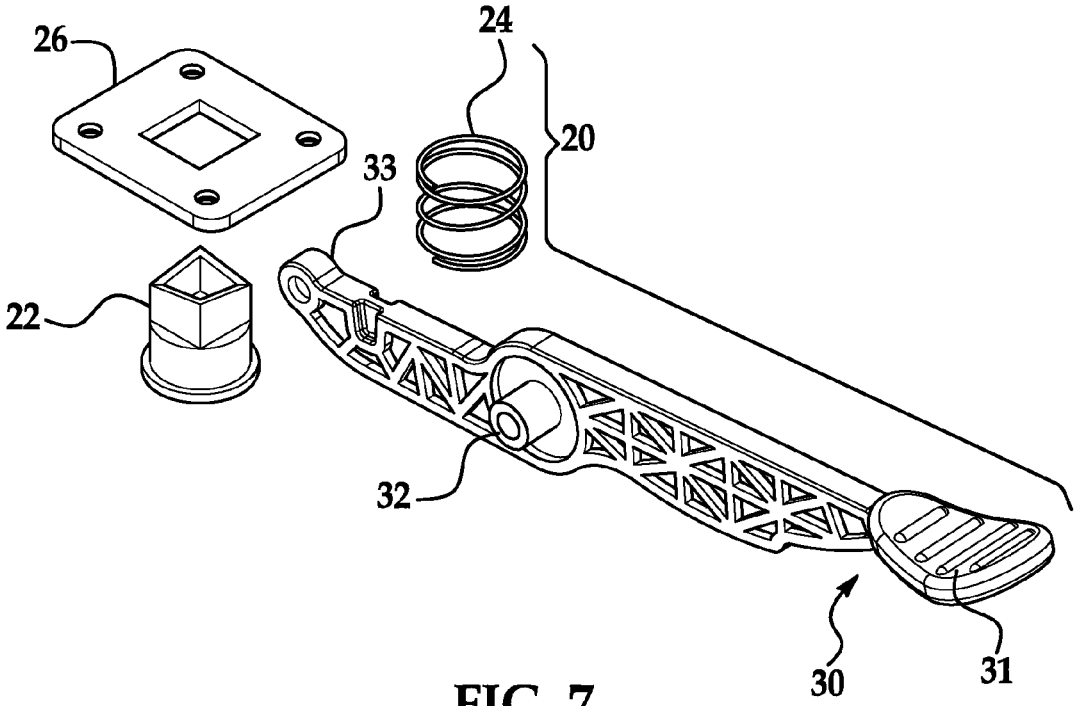
FIG. 7 is an exploded view of a cutting mechanism of an apparatus for making image jewelry tiles as disclosed herein.

Referring to FIG. 7, the cutting mechanism 20 is configured to cut images to customize a craft or jewelry project. Cutting mechanism 20 comprises cutting blade 22 shaped in a two dimensional pattern. The two dimensional pattern can be a variety of shapes and sizes, depending on the shape and size of the image tiles desired. As non-limiting examples, the blade can be in the shape of a square (as shown in FIG. 7), or circle, oval, triangle, or diamond. Additionally, the cutting mechanism 20 can include at least one tensioning member 24 and a strike plate 26. The at least one tensioning member 24 can be a spring, as shown in FIG. 7. The strike plate 26 can be configured to contact the cutting blade 22 in such a way as to limit the travel of cutting blade 22 during the cutting process.

Figure 2:
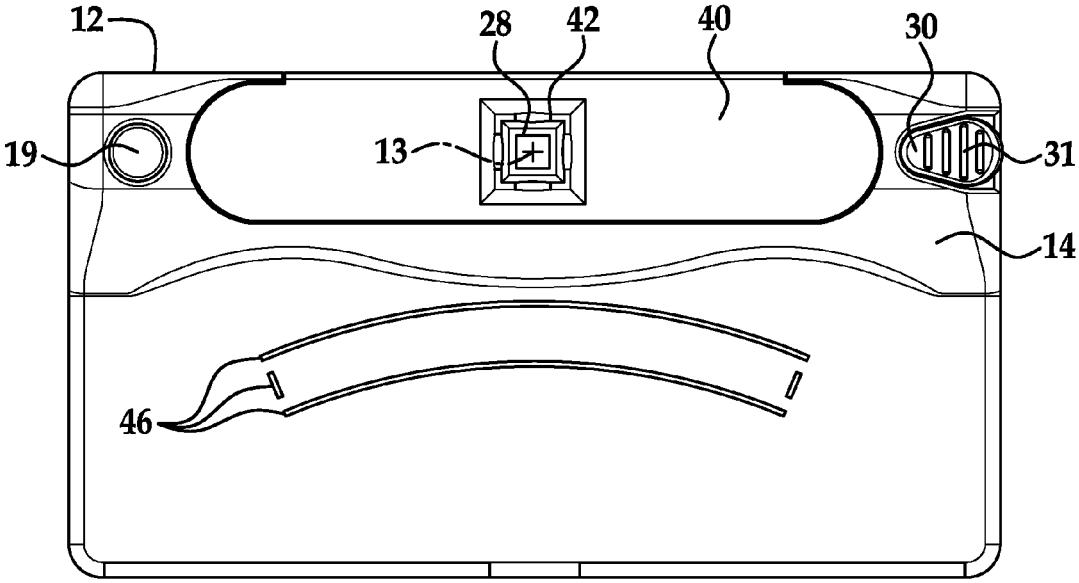
FIG. 2 is a top plan view of an embodiment of an apparatus for making image tiles as disclosed herein.
Figure 3:
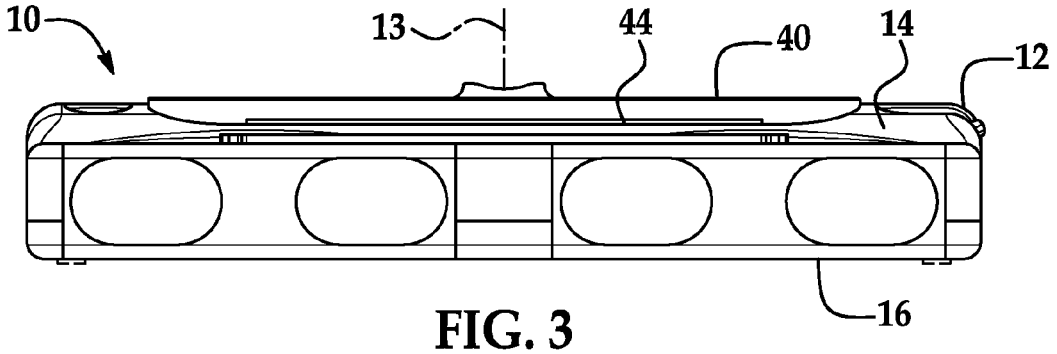
FIG. 3 is a front view of an embodiment of an apparatus for making image tiles as disclosed herein.
Figure 4:
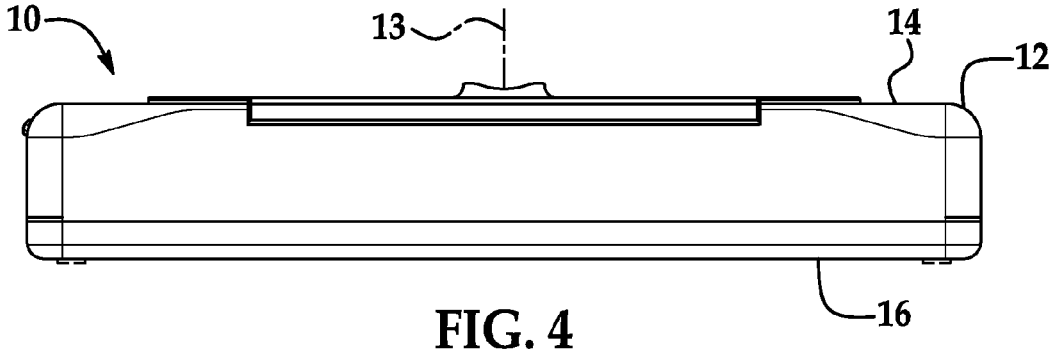
FIG. 4 is a back view of an embodiment of an apparatus for making image tiles as disclosed herein.
Figure 5:
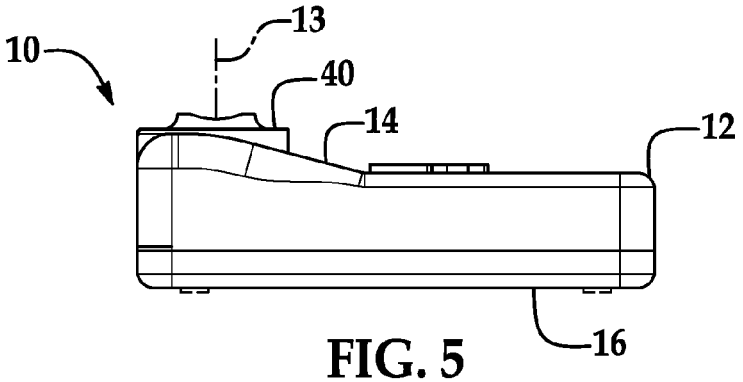
FIG. 5 is a left side view of an embodiment of an apparatus for making image tiles as disclosed herein.
Figure 6:
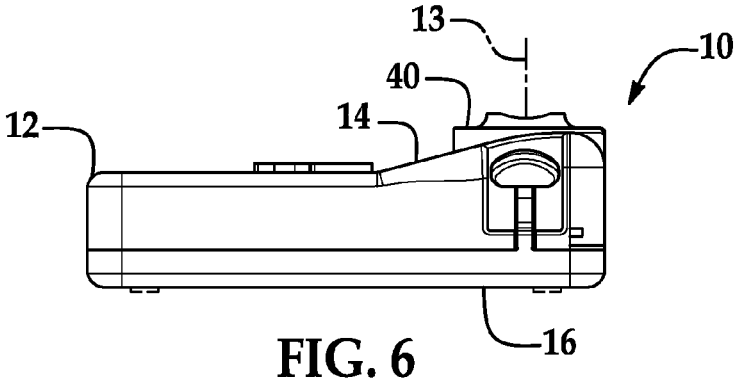
FIG. 6 is a right side view of an embodiment of an apparatus for making image tiles as disclosed herein.

The cutting mechanism 20 also includes handle 30. Handle 30 extends from the cutting blade 22 and is accessible outside of the base at a handle input end 31, as shown in FIGS. 1, 2 and 6. The handle 30 can be attached to the base 12 within the cavity 14 at base connection 32 and attached to the cutting blade 22 at cutting connection 33. In the embodiments disclosed in the figures, the base connection 32 of handle 30 is connected to the base 12 at pivot point 34 within the cavity 14, such that handle 30 can rotate about pivot point 34. Other embodiments are contemplated wherein base connection 32 can attach to the base 12 in multiple places, and can allow the handle 30 to move in a translational direction with respect to the base 12.

In the embodiments shown throughout the figures, a user can apply a force to handle input end 31 in a direction from the top surface 14 to bottom surface 16. This force would then rotate the handle 30 about pivot point 34 and the cutting connection 33 would move along axis 13. This movement of the cutting connection 33 would then in turn move the cutting blade 22 along axis 13. The cutting blade 22 is moved from a first position within the cavity 14 between the bottom surface 16 and top surface 14 to a second position in a direction along axis 13 towards top surface 14. A portion of cutting blade 22 will extend past the top surface 14 in the second position. Other embodiments of the apparatus can utilize a handle that can be moved transversely or along a one directional axis such that the input end 31 moves in a similar direction as cutting connection 33.

The tensioning member 24 applies a force to the cutting blade 22 to bias the cutting blade 22 towards the first position. In one example, this force would resist the blade moving from the first position to the second position as described above. The cutting mechanism 20 can include multiple tensioning members to achieve the proper resistance on the cutting blade 22 travel.

Apparatus 10 can include an image alignment member 40 attached to the top surface 14 of base 12 as illustrated in the Figures. Image alignment member 40 can attach to the top surface 14 at an area encompassing the aperture 28 defined in top surface 14. Image alignment member 40 has a surface 41 that is substantially planar and is substantially parallel to the top surface 14 of base 12 near the aperture 28. When attached to the base 12, a slot 44 is created between the image alignment member 40 and the top surface 14 of base 12, as evident in FIG. 1. A sheet of images 70 can then be inserted into the slot 44, thereby placing the image to be cut between the image alignment member 40 and top surface 14 of base 12. Image alignment member 40 can include an aperture 42 that overlays the aperture 28 of the top surface 14, centered on axis 13. The aperture 42 can assist a user in lining up the image to be cut prior to cutting the image. Furthermore, aperture 42 can allow the cut image to exit in an upward direction through the aperture 42, allowing easy retrieval of the cut image. The strike plate 26 of the cutting mechanism 20 can be attached to the image alignment member 40 and can act as a limit member to limit the movement of the cutting blade 22 in the upward direction.

The image alignment member 40 can also be one or more clips that extend from the base 12 under which a sheet 70 of images 72 can be slid to hold the sheet in place. Other retaining mechanisms can be used for the image alignment member 40, such as magnets, adhesive, weights, etc.

Figure 8:
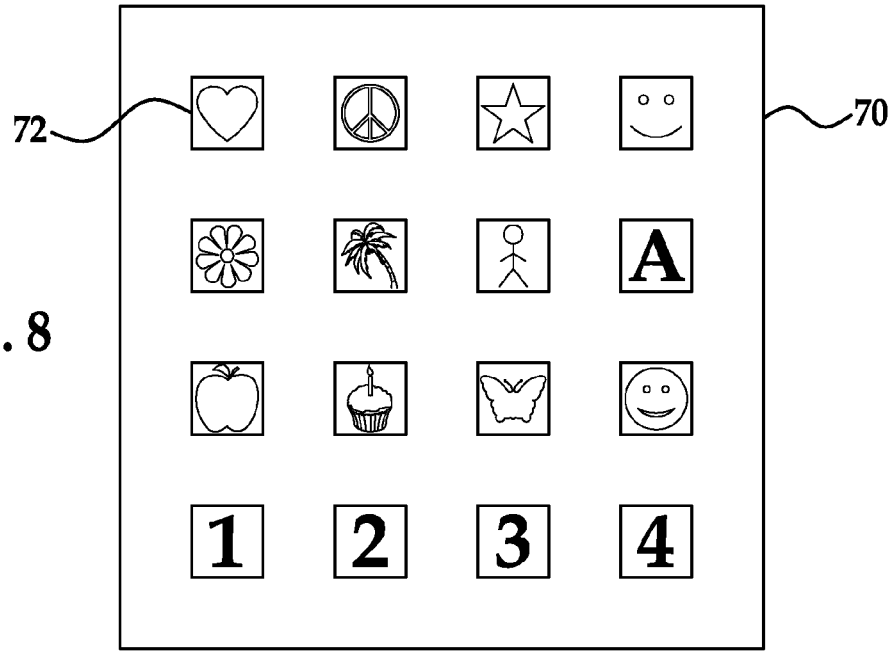
FIG. 8 is a plan view of a sheet of images.

A variety of sheets of images is contemplated to be utilized with apparatus 10, such as paper, stickers or cardboard of varying weights and thicknesses. FIG. 8 is an example of a sheet 70 of images 72. The image tile material can include pre-defined image tiles 72 with different images printed on them. The image tiles 72 may or may not have a border defining the tile, and are sized appropriately to be cut by the cutting blade 22. Furthermore, a user can create image tiles from other sources, such as photos, drawings, or any other image on suitable material. As an example, a user can size and arrange photos using software and then proceed to print them on sheets. The software can assist in properly sizing and shaping the images to be cut so that the cut images 72 contain the desired content.

Figure 9:
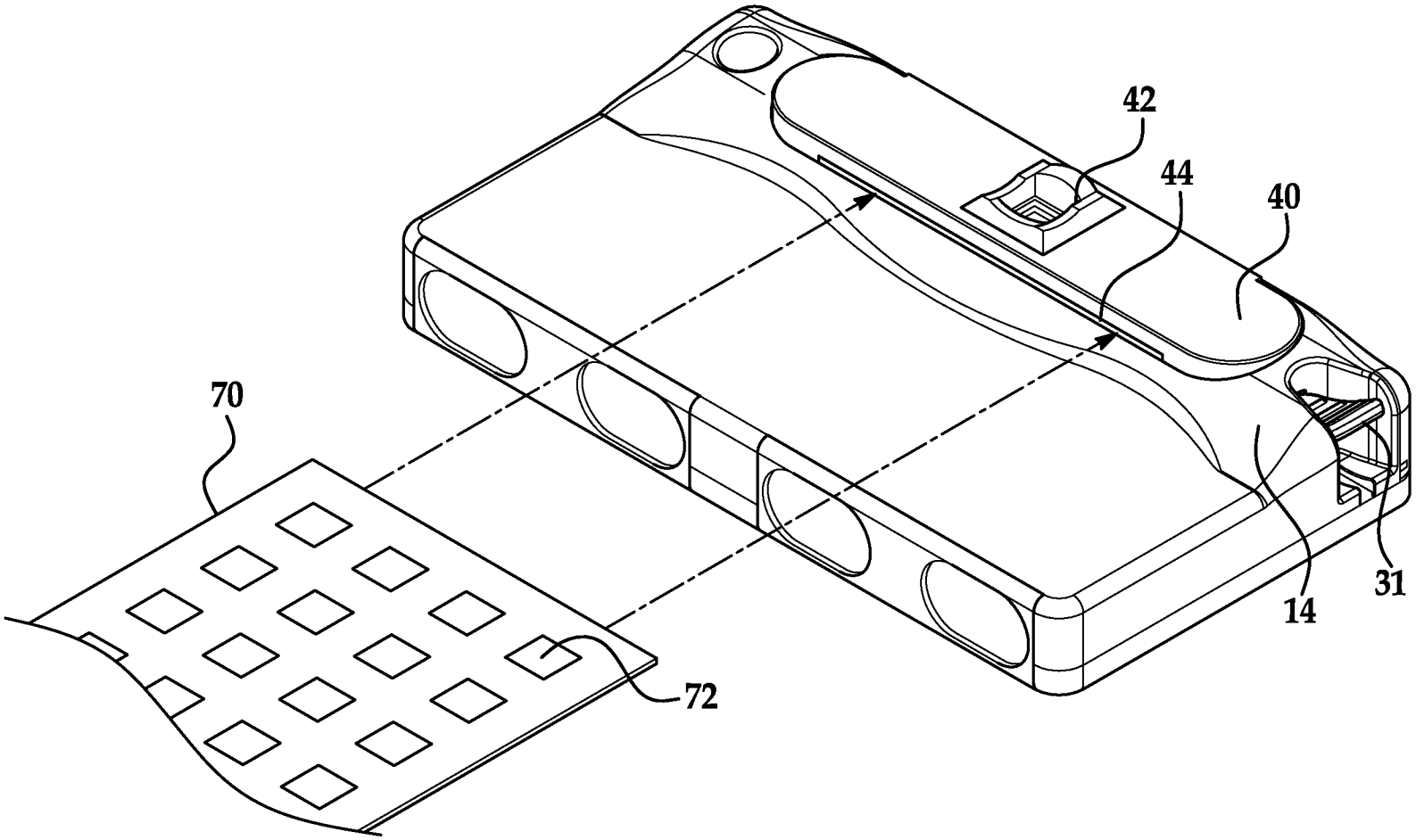
FIG. 9 is a perspective view of an apparatus for making image jewelry tiles as disclosed herein showing interaction of a sheet of images with the apparatus.

FIG. 9 illustrates feeding the sheet 70 of images 72 into slot 44 to cut an image 72 from the sheet 70. A user can insert the sheet 70 into the slot 44 created between image alignment member 40 and top surface 14. The selected image is visible through aperture 42. Once lined up appropriately, force can be applied to handle input end 31 to cause the cutting blade 22 to cut through the sheet 70 to separate the selected image 72 from the sheet 70.

Embodiments of the apparatus 10 for making custom image tiles can also comprise at least one storage compartment 50. As shown in at least FIGS. 1 and 11, the apparatus 10 comprises two storage compartments 50 as a non-limiting example. Storage compartment 50 can be configured to fit inside cavity 21 of the base 12. The storage compartment 50 can be a drawer as depicted in the figures. Storage compartment 50 can also be the bottom portion 17 of the base 12 and accessible through opening of the top portion 14 via a hinge or the like. Storage compartment 50 can further comprise storage dividers 58 to help organize items in storage. Storage compartment 50 can store anything that is sized in such a way to be retained in the storage compartment. However, it is contemplated that different strings, tiles, sheets, glue, and other decorations will be stored in storage compartment 50. The storage compartment 50 can releasably engage the base 12. For example, the storage compartment 50 can be slidably attached to the base 12 so that it is moveable between an open position and a closed position. The Figures herein illustrate the storage compartment 50 as being rectangular in shape. This shape is provided by way of example and is not meant to be limiting. The base and storage compartment can be other shapes, for example, square, triangular, hexagonal, etc. Base 12 can further include a mechanism designed to retain storage compartment 50 in a closed position, such as a latch or switch.

Base 12 can include a storage bin 19 defined in the top surface 14. Storage bin 19 can be sized to hold a variety of utensils. As a non-limiting example, storage bin 19 can hold the adhesive used to retain the image 72 to the tile.

Figure 10:
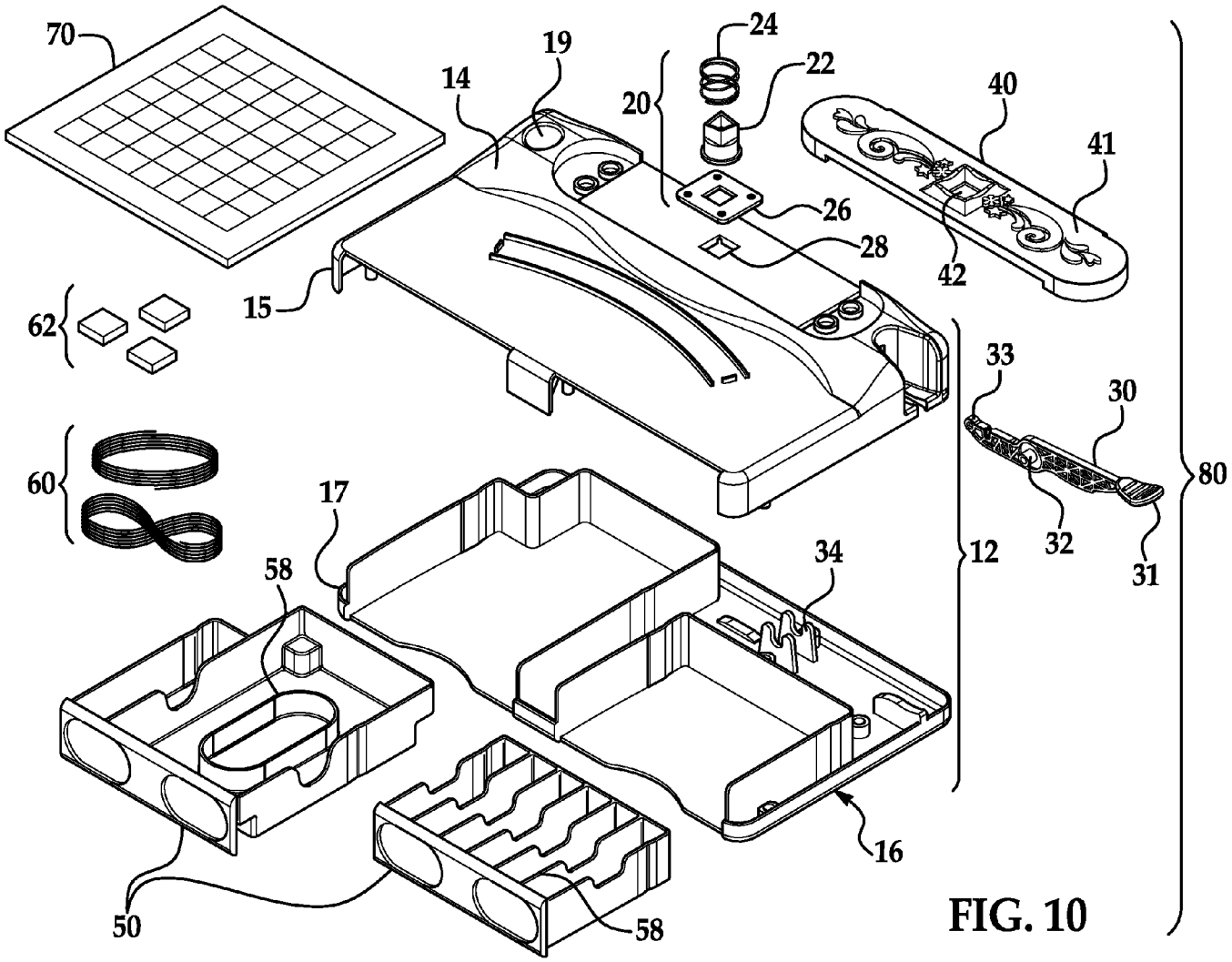
FIG. 10 is a perspective view of a kit with apparatus, tiles, sheets of images and elastic string.

Also disclosed herein are embodiments for a jewelry kit 80 for making image jewelry crafts. The jewelry kit 80 is illustrated in FIG. 10, and comprises the apparatus 10 as described above. In addition to the apparatus 10, jewelry kit 80 can comprise sheets 70, both blank and with images 72, tiles 62 and elastic string 60.

The jewelry tiles 62 are used to create jewelry and other accessories that display the images. Jewelry tiles 62 can be strung together with elastic or other string material 60 to create a variety of jewelry items, including bracelets, necklaces, charms, belts, etc. Jewelry tiles 62 can include at least one channel 68 defined therein, to allow string 60 of varying sizes to retain a plurality of jewelry tiles 62 together. The channels 68 can be located in different locations in the tiles 62. As illustrated in FIG. 11, each tile 62 has two channels 68 extending parallel to a surface 66 of the tile 62. String material 60 can be a variety of material, including an elastic material. In one embodiment jewelry tiles 62 have apertures 68 configured such that a knot tied in string 60 requires a certain level of tension force to pull the knot through aperture 68. This enables a user to tie a knot in string 60 to complete a jewelry accessory, and the pull the knot inside a jewelry tile 62 to hide the appearance of the knot.

FIG. 11 shows jewelry tiles 62 with images 72 threaded together with string material 60. In one embodiment, images 72 cut using the apparatus 10 are glued to the surfaces of the jewelry tiles 62. In this fashion, a user can decorate individual jewelry tiles 62 with images 72 created using apparatus 10. It is also contemplated that jewelry tiles 62 can retain the images 72 via other means, such as allowing for placement of the image tiles inside the jewelry tile with a transparent portion to retain the image tiles. In addition, the image tiles can be attached to the jewelry tiles 62 via several different methods, such as tape, pins, snaps, Velcro, for example. Adhesive can be included with kit 80 to assist in creating the custom jewelry tiles. Jewelry tiles 62 can further retain image 72 on either one surface or on both opposing surfaces. In one embodiment, jewelry tiles 62 are two-sided, with both sides being able to retain an image 72. Jewelry tile 62 can have a frame 64 outlining the surface 66 to which the image 72 is adhered.

Figure 12:
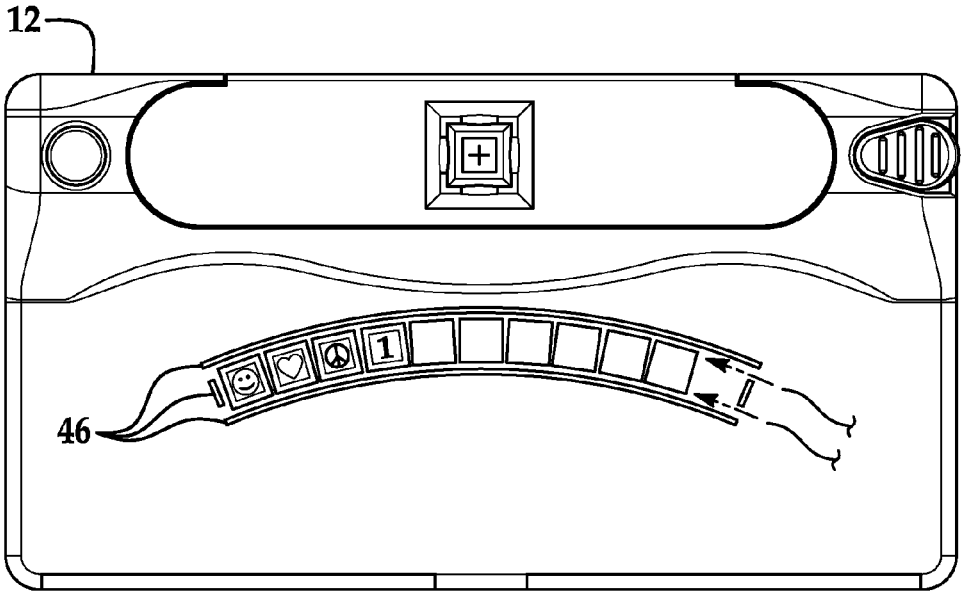
FIG. 12 is a plan view of an apparatus for making image tiles with jewelry tiles retained by raised portions on the base.

The base 12 of apparatus 10 can further comprise a tile aligner 46 configured to organize jewelry tiles 62 that are being used to create the jewelry. The tile aligner 46 can be molded into the base 12, or can be separate pieces attached to the base 12. The tile aligner 46 positions the jewelry tiles 62 in such a way to assist a user in attaching images 72 to the jewelry tiles 62 in the order desired. In addition, as shown in FIG. 12, the tile aligner 46 can align jewelry tiles 62 to assist a user in threading string material 60 through the channels 68 located in jewelry tiles 62. The tile aligner 46 can position the jewelry tiles 62 such that the channels 68 align. As a non-limiting example, FIG. 12 illustrates the tile aligner 46 as two parallel raised portions that align several tiles 62 in an arc. This arrangement aligns the channels 68 to allow a user to easily push string material 60 through multiple tiles 62 easily. The embodiment shown in FIG. 12 includes raised portions 46 that can hold several jewelry tiles, such as an amount suitable for creating bracelets.

Jewelry kit 80 includes a plurality of string 60 to help with the construction of jewelry by retaining jewelry tiles in lengths appropriate for different articles of jewelry, such as bracelets or necklaces. String 60 can include embroidery string, thread, yarn, elastic material, and any other material suitable to retain the jewelry tiles. String can be one or more colors, one or more texture, and one or more material. String can be silk, cotton, plastic, rayon, etc. The kit 80 can include as much or as little string as desired or required.

The embodiments of jewelry kit 80 disclosed herein can further comprise storage compartment 50 and/or storage bin 19 as described above. The storage compartment 50 can store the plurality of string 60 and jewelry tiles 62. Storage bin 19 can store the glue or other utensils if included with jewelry kit 80.

The other embodiments of the apparatus 10 discussed above can all be incorporated into the kit 80 as desired or required.

Figure 13:
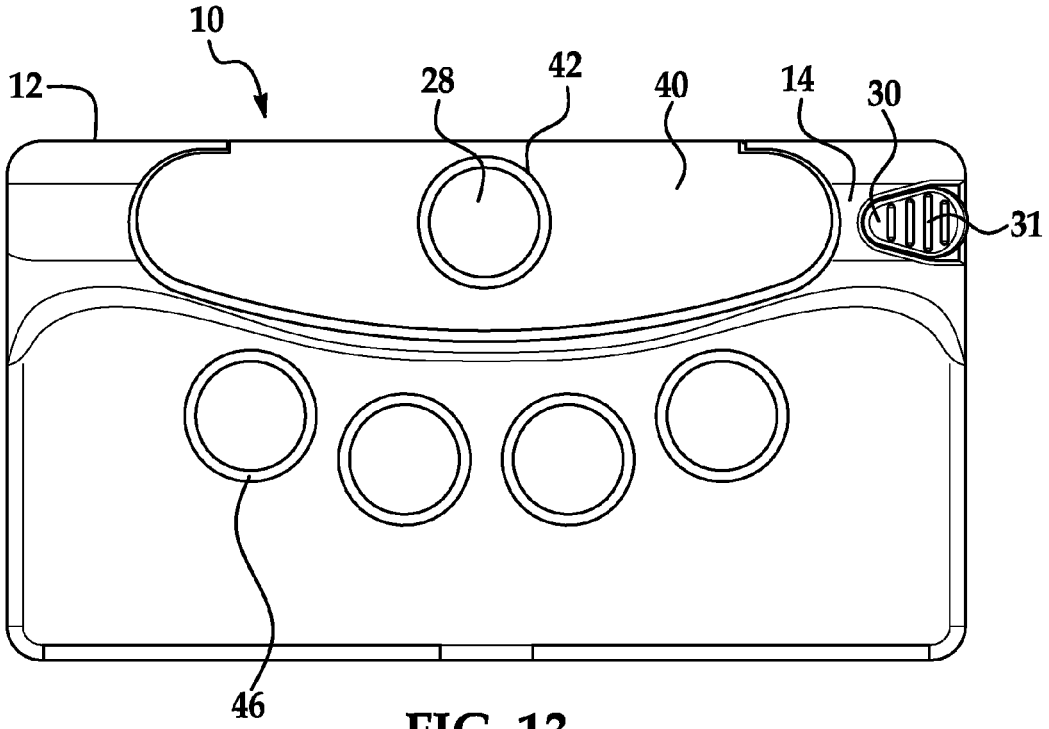
FIG. 13 is a plan view of another aspect of the apparatus for making images for jewelry and accessories.
Figure 14A:
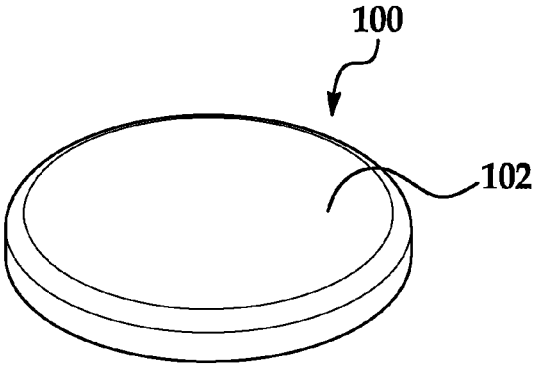
FIGS. 14A and 14B illustrate the front and back of a button configured to receive an image.
Figure 14B:
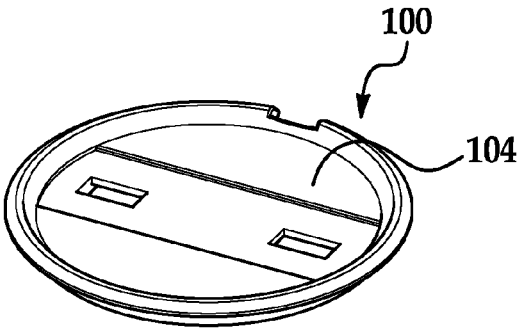

FIG. 13 illustrates another embodiment of apparatus 10 for creating circular images. Aperture 28 in top surface 14 and aperture 42 in image alignment member 40 are shaped as circles. The apparatus 10 in FIG. 13 can be used for making images to attach to jewelry tiles to create custom buttons or pins. Images 72 can be attached to jewelry tiles 62 that include clips or pins on one side, to create custom button jewelry. The tile aligner 46 can be incorporated on base 12 to retain individual jewelry tiles. For example, FIG. 13 depicts raised portions 46 in the shape of circles that are configured to retain individual jewelry tiles. The images can be attached to the jewelry tiles while the jewelry tiles are kept stationary by the raised portions 46. FIGS. 14A and 14B illustrate a button 100 that can accept a pin or clip for attached to clothing, back packs, bulletin boards, etc. or a magnet for attaching to school lockers, refrigerators, etc. FIG. 14A illustrates the front 102 of the button 100 that is configured to receive an image 72 that is cut from a sheet 70. The button 100 can have a frame around the periphery such as the tiles 62 described above if desired. The buttons 100 can be any shape desired. FIG. 14B illustrates the back 104 of the button 100 that is configured to receive a pin, clip, magnet or the like. The button 100 in FIGS. 14A and 14B is provided as an example and is not meant to be limiting.

Embodiments of the device disclosed herein can be made from plastic. Elements of the device, such as the base, cap, storage components, and handle can be molded individually and assembled or more than one element of the device can be molded together to reduce the number of parts for assembly. Embodiments of the device disclosed herein can be made out of metal, foam, resin, or any other suitable material providing the strength and rigidity necessary to function as desired or required.

Recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for making craft image tiles comprising:

a base having a top surface and a bottom surface opposite the top surface with a cavity there between;

a cutting mechanism movably positioned within the cavity and comprising a cutting blade configured to cut through a sheet of images;

a handle configured to move the cutting blade in response to a mechanical input at a handle input end through an aperture is sized to receive the cutting blade; and a plurality of tiles each configured to retain and display an image, each tile comprising:

at least one surface for retaining the image, wherein the at least one surface is two surfaces on opposing sides of the tile; and at least one channel extending through the tile in a direction parallel to a plane of the at least one surface and configured to receive a thread through the at least one channel connect at least some of the plurality of tiles.

2. The apparatus of claim 1, wherein the cutting blade is configured to move between a first position located within the cavity of the base and a second position extending past the top surface of the base.

3. The apparatus of claim 1, wherein the handle is pivotally connected to the base at a pivot point located within the cavity of the base.

4. The apparatus of claim 1, further comprising:

an image alignment member attached to the top surface of the base such that a slot is formed between the top surface and the image alignment member, the slot sized to receive the sheet of images to position a selected image time for cutting.

5. The apparatus of claim 4, wherein the image alignment member is configured to align an image of the sheet of images with the aperture and retain the sheet of images during cutting.

6. An apparatus for making craft image tiles comprising:

a base having a top surface and a bottom surface opposite the top surface with a cavity there between;

a cutting mechanism movably positioned within the cavity and comprising a cutting blade configured to cut through a sheet of images;

a handle extending from the cutting mechanism and accessible outside of the base, configured to move the cutting blade along an axis substantially perpendicular to the top surface of the base in response to a mechanical input at a handle input end, wherein the top surface includes an aperture defined therein, and the aperture is sized to receive the cutting blade; and a tile aligner positioned on the top surface of the base configured to align tiles to receive images cut from the sheet of images.

7. The apparatus of claim 2, wherein the cutting mechanism further comprises a tensioning member.

8. The apparatus of claim 1 further comprising:

a tile aligner positioned on the top surface of the base configured to align tiles to receive images cut from the sheet of images.

9. The apparatus of claim 8, wherein the tile aligner comprises two parallel non-linear raised portions sized to receive a row of tiles.

10. A kit for making craft image tiles for jewelry accessories, comprising:

an apparatus for making craft image tiles comprising:

a base having a top surface and a bottom surface and a cavity there between; and a cutting mechanism comprising a cutting blade configured to cut through a sheet of images and a handle, the handle extending from the cutting blade and accessible outside of the base, configured to move the cutting blade along an axis substantially perpendicular to the top surface of the base in response to a mechanical input, wherein the top surface includes an aperture defined therein sized to receive the cutting blade, wherein the cutting blade is configured to move from a first position within the cavity and a second position extending through the aperture;

a plurality of tiles each configured to retain and display an image; and a tile aligner positioned on the top surface of the base configured to align at least a portion of the plurality of tiles to receive images cut from the sheet of images.

11. The kit of claim 10, wherein each of the plurality of tiles has at least one channel there through, the kit further comprising a strand material configured to be threaded through one of the at least one channel of each of the plurality of tiles to form jewelry.

12. The kit of claim 11, wherein the tile aligner is further configured to receive the strand material through the at least one channel.

13. The kit of claim 10, wherein each of the plurality of tiles is configured as a button with a pin on a side opposite a side configured to display an image, and wherein the cutting blade is configured to cut round images.

14. The kit of claim 10 further comprising an image alignment member attached to the top surface of the base such that a slot is formed between the top surface and the image alignment member, the slot sized to receive the sheet of images to position a selected image time for cutting.

15. The kit of claim 10 further comprising a plurality of sheets configured to receive images for cutting.

16. The kit of claim 10 further comprising a plurality of sheets of images.

17. The kit of claim 10, further comprising:

a storage compartment received within the cavity of the base, the storage compartment movable between a first position within the cavity and a second position extending from the base such that the storage compartment is accessible to a user.

18. The apparatus of claim 1, wherein the tile has a frame around the at least one surface, the frame configured to surround a periphery of the image.

19. The apparatus of claim 6, further comprising:

a storage compartment received within the cavity of the base, the storage compartment movable between a first position within the cavity and a second position extending from the base such that the storage compartment is accessible to a user.

* * * * *